US007256337B1

(12) United States Patent
Walker

(10) Patent No.: US 7,256,337 B1
(45) Date of Patent: Aug. 14, 2007

(54) COMBINATION GUITAR PICK AND SHOULDER STRAP LOCK

(76) Inventor: Timothy John Walker, 1458 Linton Ter., Martinez, CA (US) 94553

( * ) Notice: Subject to any disclaimer, the term of this patent is extended or adjusted under 35 U.S.C. 154(b) by 35 days.

(21) Appl. No.: 11/320,714

(22) Filed: Dec. 30, 2005

(51) Int. Cl.
*G10D 3/12* (2006.01)
*G10D 3/16* (2006.01)
*G10D 3/00* (2006.01)

(52) U.S. Cl. ..... 84/327; 84/320; 84/321; 84/322; 84/329; 84/258; 84/460

(58) Field of Classification Search ..... 84/320–322, 84/327, 329, 258, 460
See application file for complete search history.

(56) References Cited

U.S. PATENT DOCUMENTS

| | | | | | |
|---|---|---|---|---|---|
| 2,961,912 | A * | 11/1960 | Meola | 84/322 |
| 2,999,125 | A * | 9/1961 | Young | 174/141 R |
| 3,442,169 | A * | 5/1969 | Bowers | 84/322 |
| 3,631,572 | A * | 1/1972 | Lange | 24/665 |
| 3,789,720 | A * | 2/1974 | McIntyre | 84/322 |
| 3,894,464 | A * | 7/1975 | Brooks | 84/327 |
| 4,144,794 | A * | 3/1979 | Silverman et al. | 84/327 |
| 4,188,851 | A * | 2/1980 | Wolf | 84/327 |
| 4,270,433 | A * | 6/1981 | Adamec | 84/322 |
| 4,271,999 | A * | 6/1981 | Stravitz | 224/257 |
| 4,274,181 | A * | 6/1981 | Schaller | 24/656 |
| 4,291,822 | A * | 9/1981 | Simonds | 224/257 |
| 4,953,267 | A * | 9/1990 | Marino et al. | 24/682.1 |
| 4,993,127 | A * | 2/1991 | Mechem et al. | 24/701 |
| 5,253,562 | A * | 10/1993 | Kline | 84/322 |
| 5,488,892 | A * | 2/1996 | Jepsen | 84/322 |
| 5,880,384 | A * | 3/1999 | Beck | 84/327 |
| 6,054,643 | A * | 4/2000 | Chance et al. | 84/322 |
| 6,080,922 | A * | 6/2000 | Dimbath | 84/327 |
| 6,140,564 | A * | 10/2000 | Pia | 84/453 |
| 6,169,238 | B1 * | 1/2001 | Bolo, III | 84/453 |
| 6,191,347 | B1 * | 2/2001 | Hoshino | 84/329 |
| 6,225,539 | B1 * | 5/2001 | Freeman | 84/322 |
| 6,259,009 | B1 * | 7/2001 | Bolo, III | 84/329 |
| 6,417,431 | B1 | 7/2002 | Wilkinson | |
| D466,546 | S * | 12/2002 | Warden | D17/20 |
| 6,815,597 | B1 * | 11/2004 | Bosley | 84/322 |
| 6,835,881 | B1 | 12/2004 | Jackson | |
| 6,949,700 | B1 * | 9/2005 | Kelly | 84/322 |
| 7,045,694 | B2 * | 5/2006 | Yasunori | 84/329 |
| 7,166,789 | B2 * | 1/2007 | Warden | 84/327 |
| 2002/0000153 | A1 * | 1/2002 | Doiron | 84/329 |
| 2005/0284282 | A1 * | 12/2005 | D'Addario et al. | 84/327 |
| 2006/0081112 | A1 * | 4/2006 | Gipson | 84/327 |

* cited by examiner

*Primary Examiner*—Lincoln Donovan
*Assistant Examiner*—Robert W. Horn
(74) *Attorney, Agent, or Firm*—Daniel Richardson

(57) ABSTRACT

A one piece combination guitar string pick and shoulder strap lock that engages and retains a guitar shoulder strap upon one or more anchor posts affixed to the guitar. The combination pick and strap lock is not a part of the shoulder strap, and is used after the shoulder strap is affixed to the guitar body using standard shoulder strap clasps. The present invention then slides over the anchor post head using the clasp arm assembly and pressing the anchor post past the clasp assembly pinch point until the anchor post head snaps against the back of the anchor post channel in the body member and the anchor post stem is then held firmly by the clasp arm assembly. Another embodiment of the invention supports adding decorative figurines for novelty. Another embodiment supports semi-permanently affixing the present invention to the anchor post with a bolt extension.

17 Claims, 3 Drawing Sheets

COMBINATION GUITAR PICK AND SHOULDER STRAP LOCK

CROSS-REFERENCE TO RELATED APPLICATIONS

N/A

FEDERALLY SPONSORED RESEARCH

N/A

SEQUENCE LISTING OR PROGRAM

N/A

BACKGROUND OF THE INVENTION

1. Field of the Invention

People who play the guitar or similar stringed instrument want the musical instrument to be positioned conveniently in front of them for play with hands and guitar string pick. Thus, the state of the art has been to use a shoulder strap temporarily affixed to either end of the guitar and placed over the shoulder or looped around the neck of the player. In order to afford both easy release of the shoulder strap when done playing and a secure lock to the anchor of the guitar during play, there have been a number of proposed solutions.

2. Prior Art

The prior art in affixing a shoulder strap to the guitar has several variations. In one variation, U.S. Pat. No. 4,271,999, Jun. 9, 1981 registered to David M. Stravitz, discloses a Guitar Strap Connector. The patent teaches a body member having a slot for connecting to the web shoulder strap and a generally key hole shaped opening consisting of two interconnected holes, one hole being large enough for the post on the guitar to fit through it and then for the post to slide into the smaller hole and lock the guitar post in the smaller hole opening.

A subsequent patent, U.S. Pat. No. 4,993,127, Feb. 19, 1991, registered to Larry J., Mechem, et. al., discloses a Locking Attachment for Guitar Straps and the Like. The patent teaches a body member having a slot for connecting to the web shoulder strap and a single large hole with a connecting slot to receive a post mounted on the guitar. Once the guitar post is inserted through the hole in the body member, it slides to the end of the slot and is held in that position with a head button that locks on the top of the post.

A subsequent patent, U.S. Pat. No. 5,880,384, Mar. 9, 1999, registered to Richard Beck, discloses a Connecting Device for Attaching Shoulder Strap to Stringed Instrument. The patent teaches an attachment device consisting of a looped portion designed to fit under the guitar strings at the stringed end of the guitar neck, and to then be affixed to the shoulder strap at the neck end with an attaching bolt mechanism. At the other end of the strap, a single opening with a slot in flexible material enables pressing the opening over the guitar post, where it remains so long as the end portion does not receive too much outward pressure to cause it to slip off the guitar mounting post.

BRIEF SUMMARY OF THE INVENTION

The present invention enables artists who play the guitar 55 or similar stringed instrument with the tapered point 11 of a guitar pick 10 to have the guitar 55 firmly affixed to the shoulder strap 50 and positioned conveniently in front of them for play with hands and guitar pick 10. During play, when the guitar 55 is affixed to the shoulder strap clasp 80 with no more than the anchor post 40 through the round anchor post opening 60 in the shoulder strap clasp, the guitar 55 can pop out of the anchor post opening 60 and fall to the floor. This happens as the material comprising the shoulder strap clasp 80 and the round anchor post opening 60 weakens through use.

The prior art, as discussed, has solved this problem with elaborate multi-part locking mechanisms. The present invention, however, solves the problem with a simple solution that can easily fit in the artist's pocket. The present invention, unlike the prior art is also not a part of the shoulder strap. The present invention is used after the shoulder strap 50 is affixed to the guitar body 55 using the standard shoulder strap clasp 80 via the round anchor post opening 60. The present invention is then used to slide the anchor post head 43 under the clasp arm assembly 20 pressing it past the clasp pinch point 25 until the anchor post head 43 clicks against the back of the anchor post channel 30 and the anchor post stem 45 is held firmly by the clasp arm assembly 20.

In addition to locking the shoulder strap clasp 80 onto the guitar body 55 anchor post 40, the present invention also provides the utility of a backup guitar pick 10 for use in playing the guitar. Obviously, a single instance of the invention cannot be used simultaneously for both purposes, i.e. playing the guitar with the guitar pick 10 tapered point 11 and locking the shoulder strap clasp 80 with the locking features. However, it is anticipated that the invention will be inexpensively mass-produced such that the artist will have several of the combination guitar pick 10 and shoulder strap locks and can use one for the locking purpose and the other for the playing purpose. If the artist has only one instance of the invention, that one can be used for either purpose.

Since the target users of this invention are musical artists who are also interested in other types of artistic variety, another embodiment of the present invention would support either permanently incorporated or temporarily mounted decorative figurines as a part of the invention. Such figurines could be popular celebrity heads, historical figures, caricatures, comical representations, or other geometric or artistic shapes.

BRIEF DESCRIPTION OF THE DRAWINGS

1. Figures

2. Reference Numerals

Figure 1:
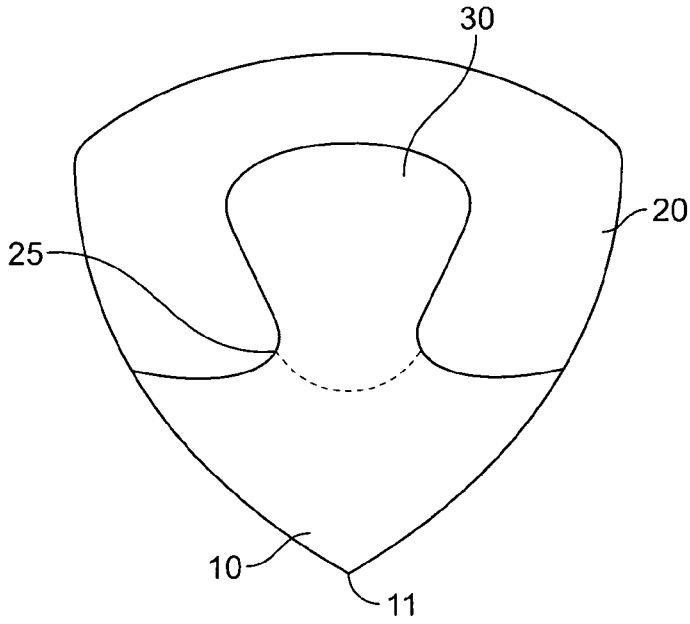
FIG. 1 depicts the invention from a top view showing the two separate clasp arms 20

10 guitar pick main tapered body shaped for use in picking guitar strings at the thinnest point and thick enough at the other end to be hollowed out to fit an anchor post 40 to the guitar

11 tapered point of the guitar pick 10, used to pick the guitar strings

12 guitar pick bolt opening on the bottom of guitar pick 10 for insertion of anchor post bolt extensions 46

20 clasp arm assembly for grasping either side of an affixing post on the guitar

25 clasp arm pinch point creating a smaller opening to keep the anchor post stem 45 firmly within the larger clasp arm assembly 20 opening and the anchor post channel 30

30 anchor post channel for guiding an anchor post 40 on the guitar from the front of the clasp arms to the rear of the channel to then lock the guitar post into the combination pick/anchor

40 anchor post for anchoring a shoulder strap to a guitar, having a rounded shape, with an anchor post head 43 and an anchor post base 47 of generally the same diameter and depth, with a joining anchor post stem 45 portion

42 anchor post head opening probably containing an anchor post bolt sleeve 49 to accommodate an anchor post bolt extension 46 when such is used

43 anchor post head is the circular top portion of the anchor post 40 which is the same diameter as the anchor post base 47, and greater in diameter than the mid-point of the anchor post stem 45

45 anchor post stem being tapered from the top of the anchor post head 43 and the anchor post base 47 to the middle between the two, and at the middle point, having the smallest diameter of the anchor post 40

46 anchor post bolt extension is probably threaded to mate with the anchor post bolt sleeve 49 to semi-permanently anchor the guitar pick 10 and shoulder strap clasp 80 to the stringed instrument on the anchor post 40.

47 anchor post base is the circular bottom portion of the anchor post 40 that is positioned and held against the guitar body 55, probably with an anchor post bolt 48

48 anchor post bolt or screw assembly to affix the anchor post 40 to the guitar body 55. In addition, in a semi-permanently affixed embodiment, the anchor post bolt 48 can be extended using the anchor post bolt sleeve 49 and anchor post bolt extension 46 through the guitar pick 10 to semi-permanently affix the guitar pick 10 rather than use the guitar pick 10 for quick slide-on/slide-off. A further use of the anchor post bolt extension 49 is in an extended version (not shown) wherein the anchor post bolt extension 49 extends beyond the guitar pick 10 and is used for a permanently attached decorative figurine, a screw-on decorative figurine or if non-threaded on the end of the anchor post bolt extension 49, then a snap-on version of a decorative figurine.

49 anchor post bolt sleeve is probably threaded to receive or mate with the anchor post bolt extension 46 that is used to semi-permanently affix the guitar pick 10 to the stringed instrument guitar body 55 or for the use of decorative figurines.

50 shoulder strap the flexible slender strap used to run from both ends of the guitar over the shoulder of the artist

55 guitar body the large elongated body portion or other portion where anchor posts 40 are affixed to a guitar or similar stringed instrument

60 round anchor post opening the opening through which the anchor post head 43 is passed, using the clearance provided by the flexible anchor post slot 70, which opens when the anchor post head 43 is forced through it near the round anchor post opening 60 and then closing after the round anchor post opening 60 has closed around the anchor post stem 45

70 anchor post slot opens when the anchor post head 43 is forced through it near the round anchor post opening 60 and then closing after the round anchor post opening 60 has closed around the anchor post stem 45, with the anchor post head 43 protruding through the round anchor post opening 60

80 shoulder strap clasp for affixing the shoulder strap to the guitar body 55 anchor post 40

DETAILED DESCRIPTION

Preferred Embodiment

FIG. 1 depicts the invention from a top view in the generally triangular shape of a standard guitar pick 10, with the tapered point 11 being used to pick guitar strings. The tapered body of the guitar pick 10 is hollowed out to form a post channel 30 that is wide enough to accommodate the anchor post head 43 portion of the anchor post 40 that is attached to the body of the guitar. Formed onto the top of the guitar pick 10 is the clasp arm assembly 20 the ends of which are raised off either side edge of the guitar pick 10 so as to accommodate the pinched shape of the anchor post stem 45 to pass through the clasp arm pinch point 25 and to then allow the anchor post head 43 to pass into the anchor post channel 30 and thence to click against the back of the anchor post channel 40 and the anchor post stem then snaps into the clasp arm assembly 20.

Figure 2:
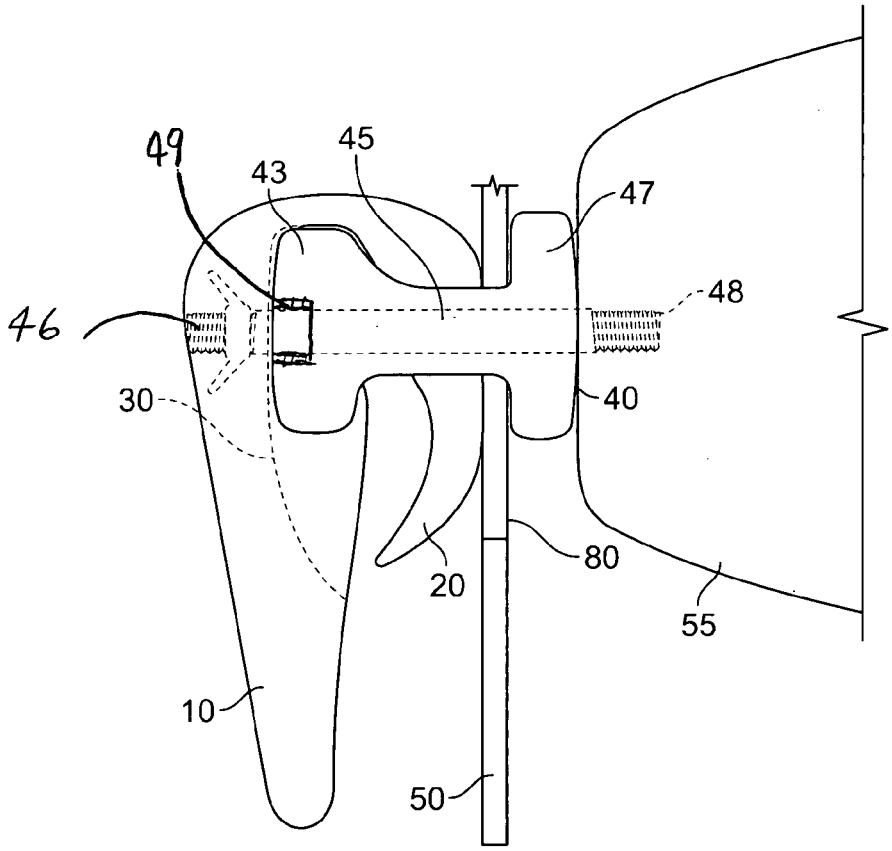
FIG. 2 depicts the invention in a cross-section from the side showing the tapered body and the clasp arm assembly 20 as used with the anchor post 40 and shoulder strap 50

FIG. 2 depicts the invention from the side showing the tapered body of the guitar pick 10, the anchor post channel 30 formed inside the larger portion of the body of the guitar pick 10, and the and the clasp arm assembly 20, that locks the anchor post 40 to the guitar body 55. The anchor post 40 is shown with the anchor post base 47 affixed to the guitar body 55 with the anchor post bolt 48. The terminating end of the anchor post bolt 48 in the anchor post head 43, shows an anchor post bolt sleeve 49 that accepts the insertion of the anchor post bolt extension 46, affixed with a wing nut. As shown, the anchor post bolt 48 is extended into the guitar pick 10 for a semi-permanent affixing of the guitar pick 10 and the shoulder strap clasp 80 to the anchor post base 47. However, if the anchor post bolt 48 is instead shortened, and the end of the anchor post bolt 48 is flush with the top of the anchor post head 43, without the insertion of an anchor post bolt extension 46, then the guitar pick 10 can be used in a quick and easy slide-on/slide-off configuration. The shoulder strap 50 is shown with the shoulder strap clasp 80 already over the anchor post 40 and the invention is shown with the anchor post head 43 resting against the end of the anchor post channel 30, and the clasp arm assembly 20 grasping the anchor post stem 45.

Figure 3:
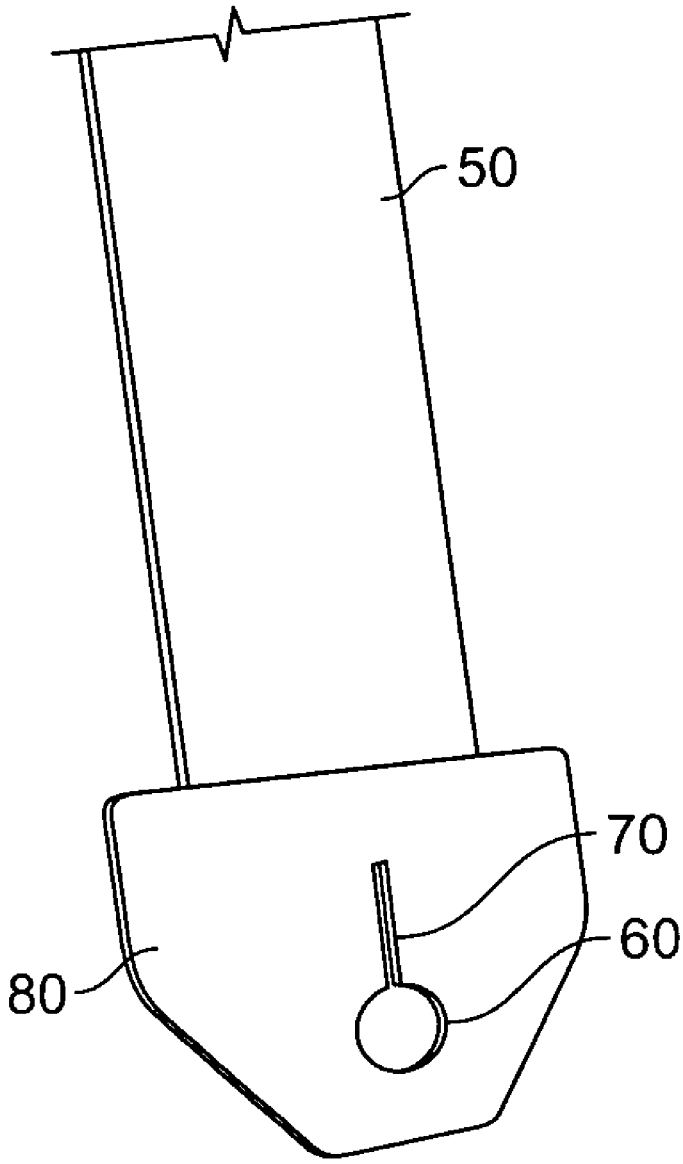
FIG. 3 shows a shoulder strap clasp 80 with typical round anchor post opening 60 and anchor post slot 70

FIG. 3 shows one end of a shoulder strap 50 that would be passed over the shoulder of the artist, the other end of the shoulder strap 50 affixed to the opposite end of the guitar body 55 with each end of the shoulder strap 50 having a shoulder strap clasp 80 with typical anchor post slot 70 and round anchor post opening 60 through which the anchor post 40 would first be forced and then the guitar pick 10 would be placed over the anchor post 40 to lock the shoulder strap 50 to the guitar body 55 (see FIG. 2).

Figure 4:
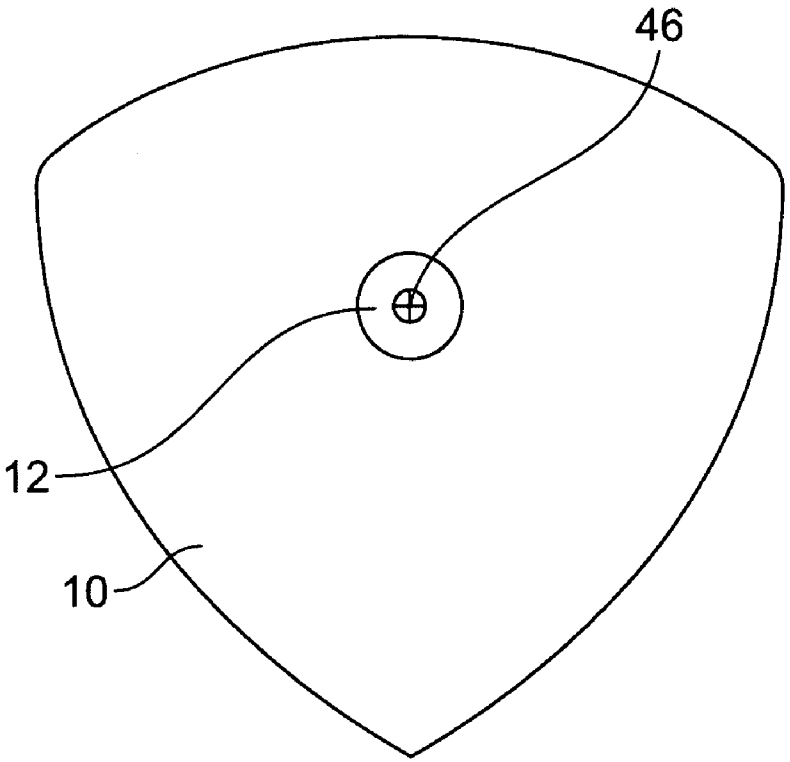
FIG. 4 depicts the invention from the bottom showing the guitar pick bolt opening 12

FIG. 4 depicts the invention from the bottom showing the guitar pick bolt opening 12 that is designed to allow for insertion of anchor post bolt extensions 46 that will semi-permanently affix the shoulder strap 50 and the guitar pick 10 to the guitar body 55. The anchor post bolt extensions 46 may also have decorative figurines permanently formed onto them or attached to them.

I claim:

1. A one piece integrally formed guitar string pick for engaging, retaining and confining a guitar shoulder strap upon an anchor post affixed to the guitar, comprising:

a body member formed into a tapered shape having a wide end gently and outwardly rounded and incorporating a clasping means, having gentle tapering side curves continuing to the narrowest pointed end, having a formed channel with the deepest portion of said channel toward the wide end; and a tapered point at the narrowest end of said body member suitable for picking guitar strings; and a channel in said body member and in said clasping means offset toward the wide end of said body member being shallow toward the narrow end and with sufficient depth adjacent to the wide end of said body member to securely accommodate the diameter and the depth of the anchor post head affixed to the stringed instrument; and a clasp arm assembly being a continuous strip with two ends and the center and widest portion formed as a part of the outer portion of the widest end of said body member with the center portion continuing the channel of said body member, each end terminating to form two tapering flexible arms both extending toward the narrow end of said body member, the center portion being the highest portion of said body member and following the tapered outer curves of said body member, the inner edge of the continuous strip forming a central anchor post opening with a diameter smaller than the diameter of the outer portion of the anchor post to accommodate the smallest diameter of the anchor post affixed to the stringed instrument with sufficient depth to accommodate the shoulder strap mounted on the anchor post; and a pinch point opening formed by the two tapering flexible arms of said clasp arm assembly being smaller than the smallest diameter of the anchor post affixed to the stringed instrument; and an anchor post bolt affixing the anchor post to the stringed instrument wherein the top end of said anchor post bolt has an internally threaded sleeve contained within and flush with the top of the anchor post head.

2. The one piece integrally formed guitar string pick according to claim 1 wherein said body member is integrally and unitarily made of resilient plastic material.

3. The one piece integrally formed guitar string pick according to claim 1 wherein said body member is integrally and unitarily made of polypropylene material.

4. The one piece integrally formed guitar string pick according to claim 1 wherein said body member is integrally and unitarily made of nylon material.

5. The one piece integrally formed guitar string pick according to claim 1 wherein said body member has a protruding extension from the widest end of said body member to support affixing decorative figurines.

6. The one piece integrally formed guitar string pick according to claim 1 wherein said body member has a decorative figurine protruding from the widest end of said body member.

7. The one piece integrally formed guitar string pick according to claim 1 wherein the two tapering flexible arms of said clasp arm assembly flex open when the narrow portion of the anchor post affixed to the stringed instrument and having the shoulder strap on the anchor post is pressed into said pinch point opening and said clasp arm assembly then snaps back after the anchor post passes into said channel in said body member.

8. The one piece integrally formed guitar string pick according to claim 1 wherein one end of said anchor post bolt has threads to screw into the stringed instrument body and the other end of said anchor post bolt has a non-threaded sleeve contained within and flush with the top of said anchor post head.

9. A one piece integrally formed guitar string pick for engaging, retaining and confining a guitar shoulder strap upon an anchor post affixed to the guitar, comprising:

a body member having a round opening on the bottom and said body member formed into a tapered shape having a wide end gently and outwardly rounded and incorporating a clasping means, having gentle tapering side curves continuing to the narrowest pointed end, having a formed channel with the deepest portion of said channel toward the wide end; and a tapered point at the narrowest end of said body member suitable for picking guitar strings; and a channel in said body member and in said clasping means offset toward the wide end of said body member being shallow toward the narrow end and with sufficient depth adjacent to the wide end of said body member to securely accommodate the diameter and the depth of the anchor post head affixed to the stringed instrument; and a clasp arm assembly being a continuous strip with two ends and the center and widest portion formed as a part of the outer portion of the widest end of said body member with the center portion continuing the channel of said body member, each end terminating to form two tapering flexible arms both extending toward the narrow end of said body member, the center portion being the highest portion of said body member and following the tapered outer curves of said body member, the inner edge of the continuous strip forming a central anchor post opening with a diameter smaller than the diameter of the outer portion of the anchor post to accommodate the smallest diameter of the anchor post affixed to the stringed instrument with sufficient depth to accommodate the shoulder strap mounted on the anchor post; and a pinch point opening formed by the two tapering flexible arms of said clasp arm assembly being smaller than the smallest diameter of the anchor post affixed to the stringed instrument; and an anchor post bolt affixing the anchor post to the stringed instrument wherein the top end of said anchor post bolt has an internally threaded sleeve contained within and flush with the top of the anchor post head that aligns with the bottom opening of said body member when the anchor post is snapped into said body member channel under said clasp arm assembly.

10. The one piece integrally formed guitar string pick according to claim 9 wherein said body member is integrally and unitarily made of resilient plastic material.

11. The one piece integrally formed guitar string pick according to claim 9 wherein said body member is integrally and unitarily made of polypropylene material.

12. The one piece integrally formed guitar string pick according to claim 9 wherein said body member is integrally and unitarily made of nylon material.

13. The one piece integrally formed guitar string pick according to claim 9 wherein said body member has a protruding extension from the widest end of said body member to support affixing decorative figurines.

14. The one piece integrally formed guitar string pick according to claim 9 wherein said body member has a decorative figurine protruding from the widest end of said body member.

15. The one piece integrally formed guitar string pick according to claim 9 wherein the two tapering flexible arms of said clasp arm assembly flex open when the narrow portion of the anchor post affixed to the stringed instrument and having the shoulder strap on the anchor post is pressed into said pinch point opening and said clasp arm assembly then snaps back after the anchor post passes into said channel in said body member.

16. The one piece integrally formed guitar string pick according to claim 9 wherein one end of said anchor post bolt has threads to screw into the stringed instrument body and the other end of said anchor post bolt has a non-threaded sleeve contained within and flush with the top of said anchor post head.

17. The one piece integrally formed guitar string pick according to claim 9 wherein said sleeve at the end of the anchor post bolt and contained in said anchor post head is aligned with said hole in said body member and allows for the insertion of an anchor bolt extension through said body member hole and into said sleeve with decorative figurine attached.

* * * * *